US008539620B1

(12) United States Patent
Wynh

(10) Patent No.: US 8,539,620 B1
(45) Date of Patent: Sep. 24, 2013

(54) BABY SWADDLING APPARATUS

(71) Applicant: Jennifer Wynh, Anaheim, CA (US)

(72) Inventor: Jennifer Wynh, Anaheim, CA (US)

( * ) Notice: Subject to any disclaimer, the term of this patent is extended or adjusted under 35 U.S.C. 154(b) by 0 days.

(21) Appl. No.: 13/716,146

(22) Filed: Dec. 16, 2012

(51) Int. Cl.
*A41B 13/06* (2006.01)

(52) U.S. Cl.
USPC ..... 5/494; 5/485; 5/486; 5/413 R; 5/416

(58) Field of Classification Search
USPC ..... 5/494, 413 R, 485, 486, 416; 2/69.5, 2/71, 72, 75; 296/81, 82; D2/719
See application file for complete search history.

(56) References Cited

U.S. PATENT DOCUMENTS

| | | | | |
|---|---|---|---|---|
| 2,675,552 | A * | 4/1954 | Jackson | 2/69.5 |
| 4,897,885 | A * | 2/1990 | Lunt | 2/69.5 |
| 5,819,317 | A * | 10/1998 | Conway | 2/111 |
| 6,393,612 | B1 * | 5/2002 | Thach et al. | 2/69.5 |
| 6,948,200 | B2 * | 9/2005 | Wyman | 5/494 |
| D675,808 | S * | 2/2013 | Sutton | D2/719 |
| 2005/0125895 | A1 * | 6/2005 | Gatten | 5/482 |
| 2009/0099632 | A1 * | 4/2009 | Krier | 607/108 |
| 2011/0231993 | A1 * | 9/2011 | Schmid et al. | 5/494 |
| 2012/0110716 | A1 * | 5/2012 | Christensen et al. | 2/69.5 |
| 2012/0151654 | A1 * | 6/2012 | Chopak et al. | 2/69.5 |
| 2012/0216349 | A1 * | 8/2012 | Kaplan et al. | 5/494 |
| 2012/0284922 | A1 * | 11/2012 | Gangan et al. | 5/494 |

* cited by examiner

*Primary Examiner* — William Kelleher
(74) *Attorney, Agent, or Firm* — John D. Tran; Rhema Law Group, P.C.

(57) ABSTRACT

A baby swaddle apparatus can comprise generally a torso portion, a blanket portion, and a pouch portion. The torso portion having a plurality of panels and containing a torso waist opening and neck opening to receive a baby inside of the torso portion. The front panel of the torso also comprising at least one fastener. The blanket portion coupled to the torso rear panel comprising of a blanket panel containing an exterior and interior side and at least one fastener. The pouch portion can contain a pouch opening which receives the baby's legs. The pouch comprising of a pouch front and rear panel and a pouch front panel which contains a plurality of fasteners which allow the pouch to be modified in a way to allow for at least one leg opening.

16 Claims, 9 Drawing Sheets

BABY SWADDLING APPARATUS

INCORPORATION BY REFERENCE

Applicant(s) hereby incorporate herein by reference any and all U.S. patents and U.S. patent applications cited or referred to in this application.

BACKGROUND OF THE INVENTION

1. Field of the Invention

Aspects of this invention relate generally to devices that can be used for clothing a baby, specifically for swaddling purposes. For the purposes of this application, the inventor uses the terms baby, infant and newborn interchangeably. In addition, the inventor uses the terms device and apparatus interchangeably.

2. Description of Related Art

Swaddling devices are commonly used by hospitals, parents and baby caretakers in an effort to prevent a baby's arms and legs from moving in an uncontrolled manner. The unrestrained movement can cause a baby's limbs, particularly the arms, to hit the baby's face or other areas causing potential injury and interrupting the baby's ability to obtain restful and uninterrupted sleep. Swaddling also intends to mimic the tight/compact environment within the mother's womb in which further soothes the baby to allow for better sleeping behavior. Swaddles can be as simple as a blanket that is wrapped around the baby or more complex comprising of individual straps that wrap around the baby and secured commonly by hook and fasteners or other similar coupling mechanisms. Simple swaddles such as a blanket become loosened easily and lose their effectiveness and also risk that portions of the blanket may be loosened in such a way where a portion of the blanket may interfere with a baby's breathing. More complex swaddles that require straps to be pulled tightly around the baby's limbs often cause uneven pressure on the baby's limbs and if the fastening mechanism becomes loosened can cause portions of the straps to be loosened in a way where a portion of the straps may push up against a baby's throat area whereby causing the potential risk of choking and suffocation. Instead of incorporating the use of straps, some swaddles are in the form of a sack that can be zipped up to enclose the baby's limbs. Although convenient, often times the sack type swaddles do not provide sufficient swaddle support for the baby's limbs thereby providing poor immobilization of the baby's limbs, in particular the baby's arms.

Moreover, all of the aforementioned swaddling devices require the baby to be placed within the device in which the baby's legs are confined within the swaddling device without options to allow the baby's legs to be free and unrestrained.

SUMMARY OF THE INVENTION

The present invention remedies the deficiencies of known swaddling devices by providing an easy-to-use baby swaddling apparatus that provides different levels of immobilization of a baby's arms without excessive pressure and while leaving the baby's head unencumbered.

Another aspect of at least one exemplary embodiment disclosed herein includes the ability to provide a variety of swaddle configurations in regards to accommodating changes in temperature thereby adjusting the comfortability for the baby in a variety of environments.

Another aspect of at least one exemplary embodiment disclosed herein includes the realization that a baby swaddling apparatus can be designed in a way that allows the lower portion of the swaddle to be modified while the baby is inside the swaddle without having the need to remove the baby from the swaddling device which risks waking up or disturbing the baby during sleep periods.

Another aspect of at least one exemplary embodiment disclosed herein includes the ability to provide a baby swaddling apparatus that allows for a legs-free configuration which improves comfortability and accommodates for changes in temperature.

Thus, in accordance with at least one exemplary embodiment, a baby swaddle apparatus can comprise generally a torso portion, a blanket portion, and a pouch portion. The torso portion having a plurality of panels and containing a torso waist opening and neck opening to receive a baby inside of the torso portion. The front panel of the torso also comprising at least one fastener.

The blanket portion coupled to the torso rear panel comprising of a blanket panel containing an exterior and interior side and at least one fastener.

In the exemplary embodiment, the pouch portion can contain a pouch opening which receives the baby's legs. The pouch comprising of a pouch front and rear panel and a pouch front panel which contains a plurality of fasteners which allow the pouch to be modified in a way to allow for at least one leg opening.

In accordance with another exemplary embodiment, a method of swaddling a baby can comprise providing a baby swaddling device comprising a torso portion having a neck opening and a torso waist opening and being selectively openable and closeable between the neck and waist openings; a blanket portion having a blanket panel joined to the rear of the torso portion and configured to selectively wrap at least partially around the torso portion and a pouch portion having a pouch front panel with a selectively foldable pouch front panel flap whereby in a first operable configuration of the apparatus the pouch front panel flap is folded substantially upwardly in the direction of the torso portion so as to form a first and second space within the apparatus bounded by the torso portion and the pouch portion, thereby enabling the legs of the baby to be positioned substantially within the pouch portion between the pouch front and rear panels allowing for a legs-free configuration.

A primary objective inherent in the present invention and method of use is to provide advantages not taught by the prior art.

Another objective inherent in the present invention and method of use is to provide a baby swaddle apparatus that can be used in a variety of configurations to accommodate different comfortability levels of a baby without the need for the caretaker to remove the baby from the swaddling apparatus.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an elements can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Figure 1:
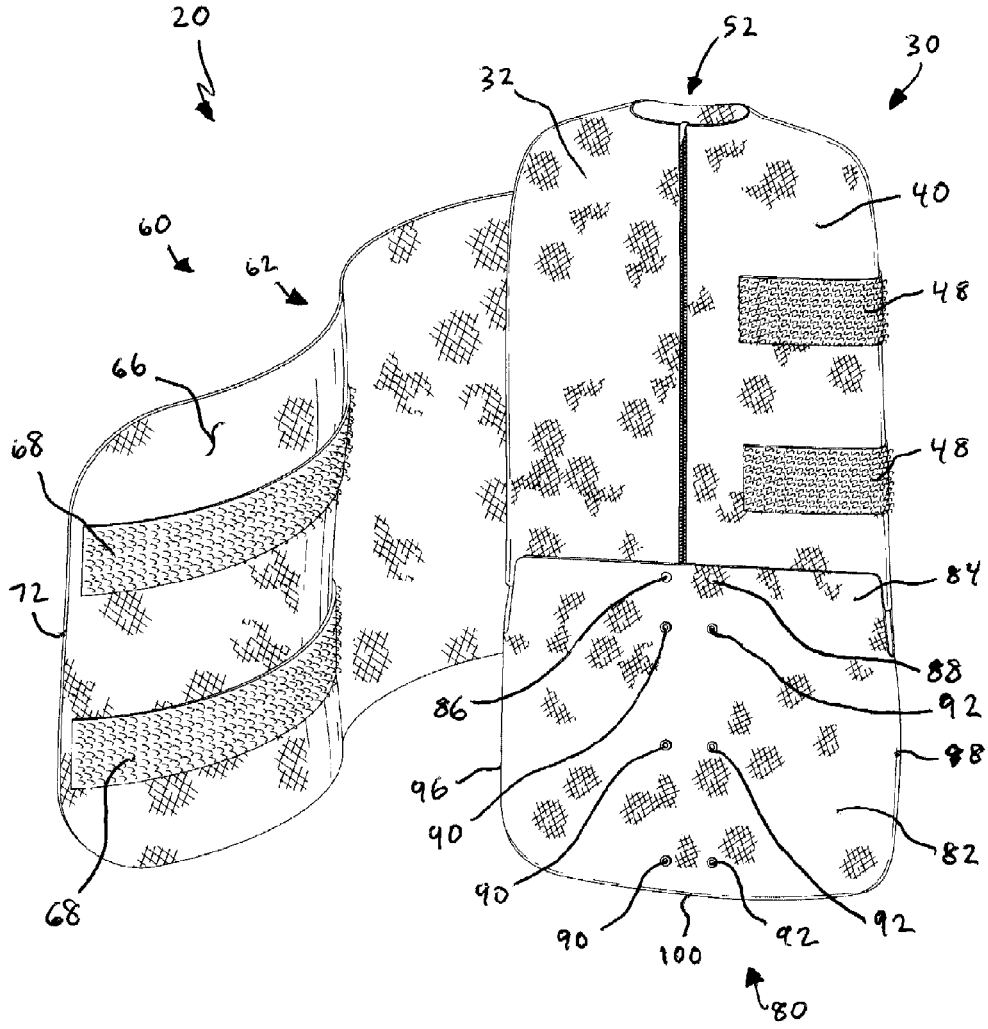
FIG. 1 is a perspective view of the baby swaddle apparatus according to an aspect of the inventive subject matter showing the torso portion in a closed position, a blanket portion and the pouch front panel in a fastened positioned.

As shown in FIG. 1, there is shown a perspective view of an exemplary embodiment of a baby swaddle apparatus 20 according to an aspect of the inventive subject matter comprising generally a torso portion 30, a blanket portion 60, and a pouch portion 80. In particular, the torso portion containing a front right panel 32, and a front left panel 40 where both said panels can be fastened together via a front right panel zipper 36 (not shown) and a torso neck opening 52. In one preferred embodiment, the torso portion 30 may contain at least one front panel fastener 48. FIG. 1 further shows the blanket portion 60 having a blanket panel proximal edge (not shown) and a blanket panel distal edge 72 comprising of a blanket panel 62, blanket exterior side (not shown), and a blanket interior side 66. In one preferred embodiment, the blanket interior side 66 may contain at least one fastener panel 68 which may allow the blanket to securely fasten to the torso portion 30 at the at least one fastener panel 48 on the torso portion 30. In one preferred embodiment, the fasteners may be in the form of a hook and loop type fastener but one can appreciate that any similar like fastener means can be used to accomplish an equivalent like result of securing the blanket portion 60 to the torso portion 30. Moreover, any and all such means for removable or temporary engagement fasteners, now known or further developed, can be substituted without departing from the spirit and scope of the invention including but not limited to fasteners such as zippers, buttons, snaps, and hook and loop.

Figure 2:
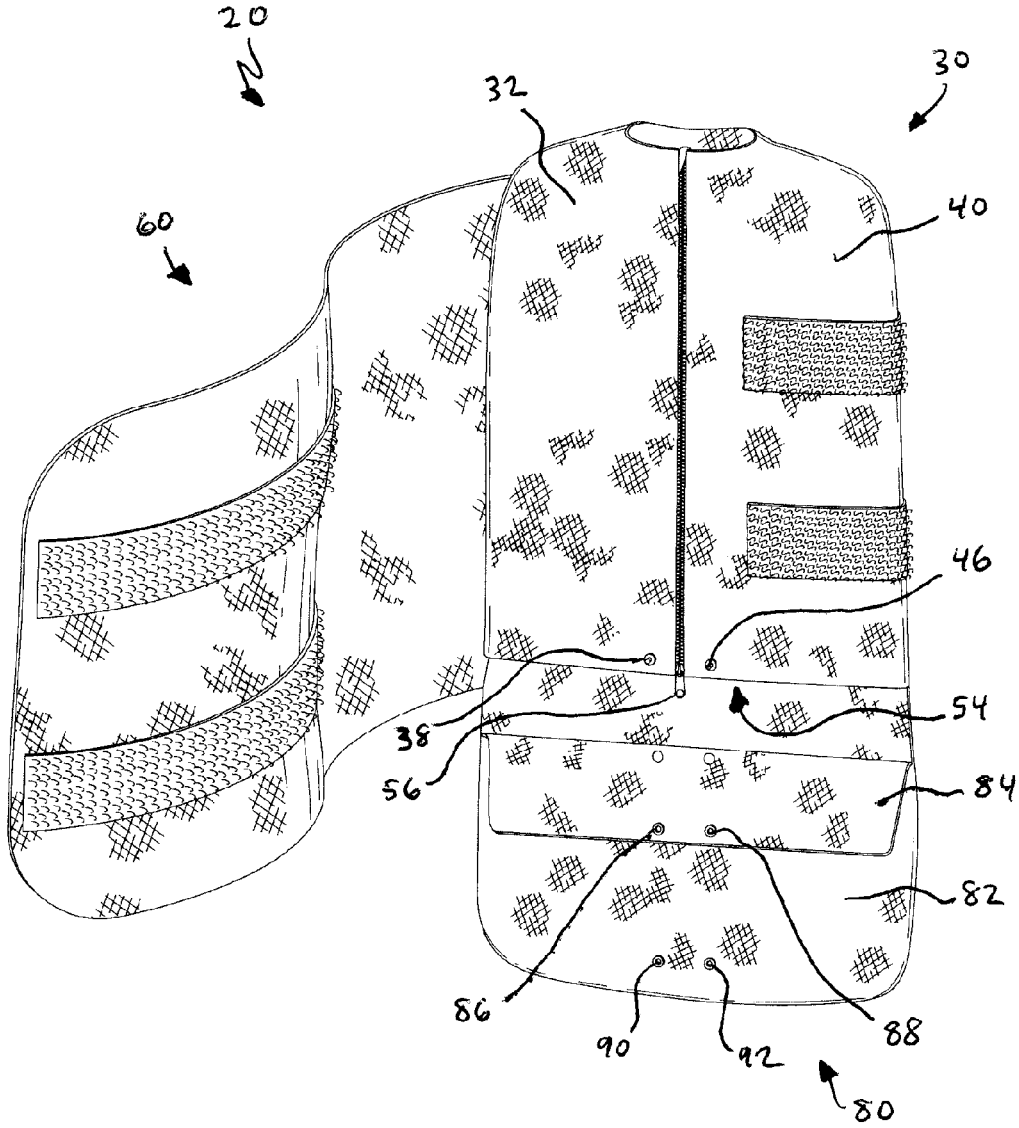
FIG. 2 is a perspective view of the baby swaddle apparatus according to an aspect of the inventive subject matter showing the pouch front panel flap in an unfastened position exposing the zipper pull of the torso portion.

Moving further down on FIG. 1 reveals a pouch portion 80 comprising of pouch front panel 82, a pouch front panel flap 84, a plurality of fasteners (86, 88, 90, 92), a pouch rear panel (not shown), a pouch right lengthwise edge 96, a pouch left lengthwise edge 98, and a bottom edge 100 in a fastened position. FIG. 2 depicts the same exemplary embodiment of FIG. 1 but with the pouch front panel flap 84 unfastened from the front right panel fastener 38 and the front left panel fastener 46 which reveals the zipper pull 56 of the torso portion 30 and also reveals the torso waist opening 54 which is an opposite opening to the torso neck opening 52. In one preferred embodiment, the zipper pull may be covered to provide for better protection. In one exemplary preferred embodiment, the pouch portion 80 having a pouch front panel 82 joined to a substantially opposite pouch rear panel, the pouch rear panel being further joined to the torso rear panel adjacent the torso waist opening 54, the pouch front panel 82 further having a selectively foldable pouch front panel flap 84, whereby in a first operable configuration of the baby swaddle apparatus 20 the pouch front panel flap 84 is folded substantially upwardly in the direction of the torso portion 30 so as to form a first space within the apparatus bounded by the torso portion 30 and the pouch portion 80, thereby enabling the legs L of the baby to be positioned substantially within the pouch portion 80 between the pouch front and rear panels (82, 94) and thus the apparatus to substantially enclose the baby B other than the head H, and whereby in a second operable configuration of the apparatus the pouch front panel flap 84 is folded substantially downwardly away from the torso portion 30, the pouch front and rear panels (82, 94) are brought substantially adjacent, and the pouch portion 30 is gathered and folded substantially upwardly in the direction of the torso portion 30 so as to be removably joined therewith so as to form a second space bounded by the torso portion with right and left leg openings between the torso portion 30 and the pouch portion 80, and further whereby whether in the first or second operable configuration of the apparatus, the blanket portion is selectively wrapped substantially at least partially around the torso portion so as to further confine the baby within the apparatus, whereby in both the first and second operable configurations of the apparatus 20 and irrespective of the position of the blanket portion 60, the baby B may be accessed via the pouch portion 80 for diaper changing with minimal disruption to the baby.

Figure 3:
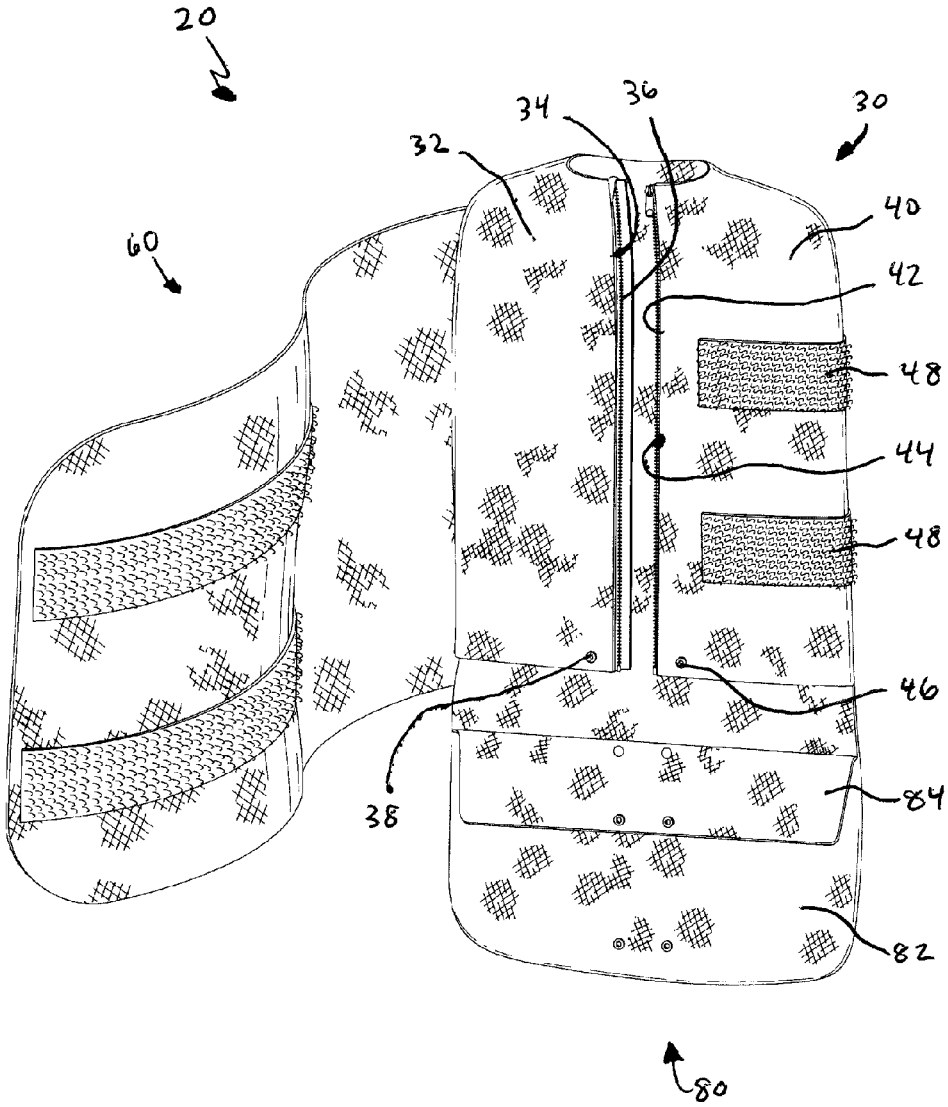
FIG. 3 is a perspective view of the baby swaddle apparatus according to an aspect of the inventive subject matter showing the torso portion in an unfastened position and pouch front panel flap in an unfastened position.

Turning to FIG. 3 shows an exemplary embodiment of the baby swaddle apparatus 20 according to an aspect of the inventive subject matter whereas the torso 30 contains a front right panel 32 comprising of a front right panel edge 34 and a left panel 40 comprising of a front left panel edge 42 thereby having the torso neck opening 52 and the torso waist opening 54 being selectively openable and closable between the neck and waist openings along the torso front right and left panels edges (36, 42) via the front left panel zipper 44.

Figure 4:
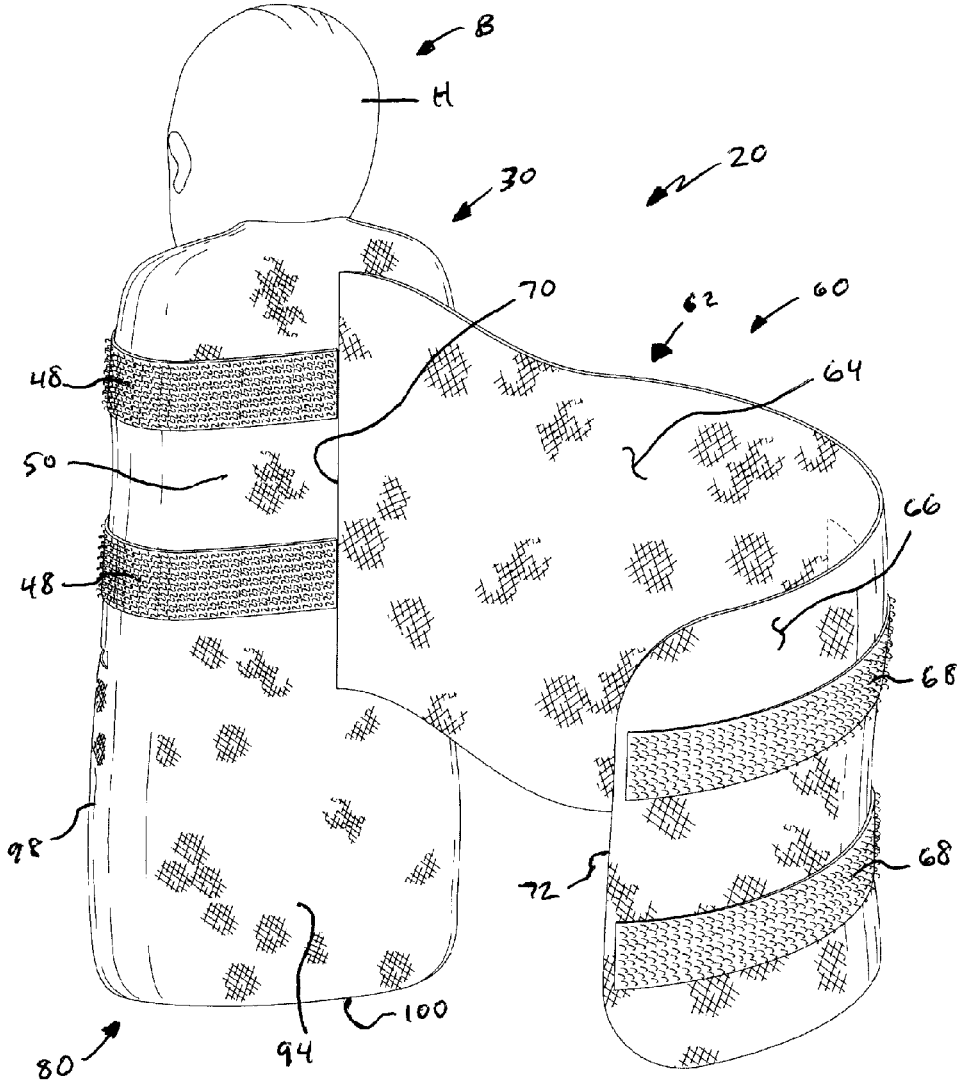
FIG. 4 is a rear perspective view of baby swaddle apparatus according to an aspect of the inventive subject matter depicting the blanket portion proximal edge coupled to the torso rear panel.

FIG. 4 clearly depicts an exemplary embodiment of the baby swaddle apparatus 20 showing a baby B being swaddled inside the baby swaddle device with the baby's head H exposed. the blanket portion 60 being coupled to the torso rear panel 50 at the blanket panel proximal edge 70 regions which extends from the top rear of the torso real panel 50 and extending down to the pouch rear panel 94. Here, the blanket panel exterior side 64 is shown which becomes the exterior of the blanket portion 60 when the blanket portion 60 is wrapped around the torso portion 30. In another preferred embodiment, when not in use, the user may fold the blanket 60 and secure it to the torso rear panel 50 by attaching at least one blanket panel fastener panel 68 to at least one of the torso left panel fastener panel 48. The ability to safely secure the blanket portion 60 when not in use is advantageous to prevent or decrease the chance that the loose blanket portion 60 may unintentionally cover or disturb portions of the baby's mouth area whereby causing complications with the baby's breathing.

It should be noted that the baby B is considered swaddled in FIG. 4 and the user may find that this configuration and level of immobilization of the baby's arms resulting from the fastened torso portion 30 is sufficient and thus choose not to use the blanket portion 60 as additional swaddling support.

Figure 5:
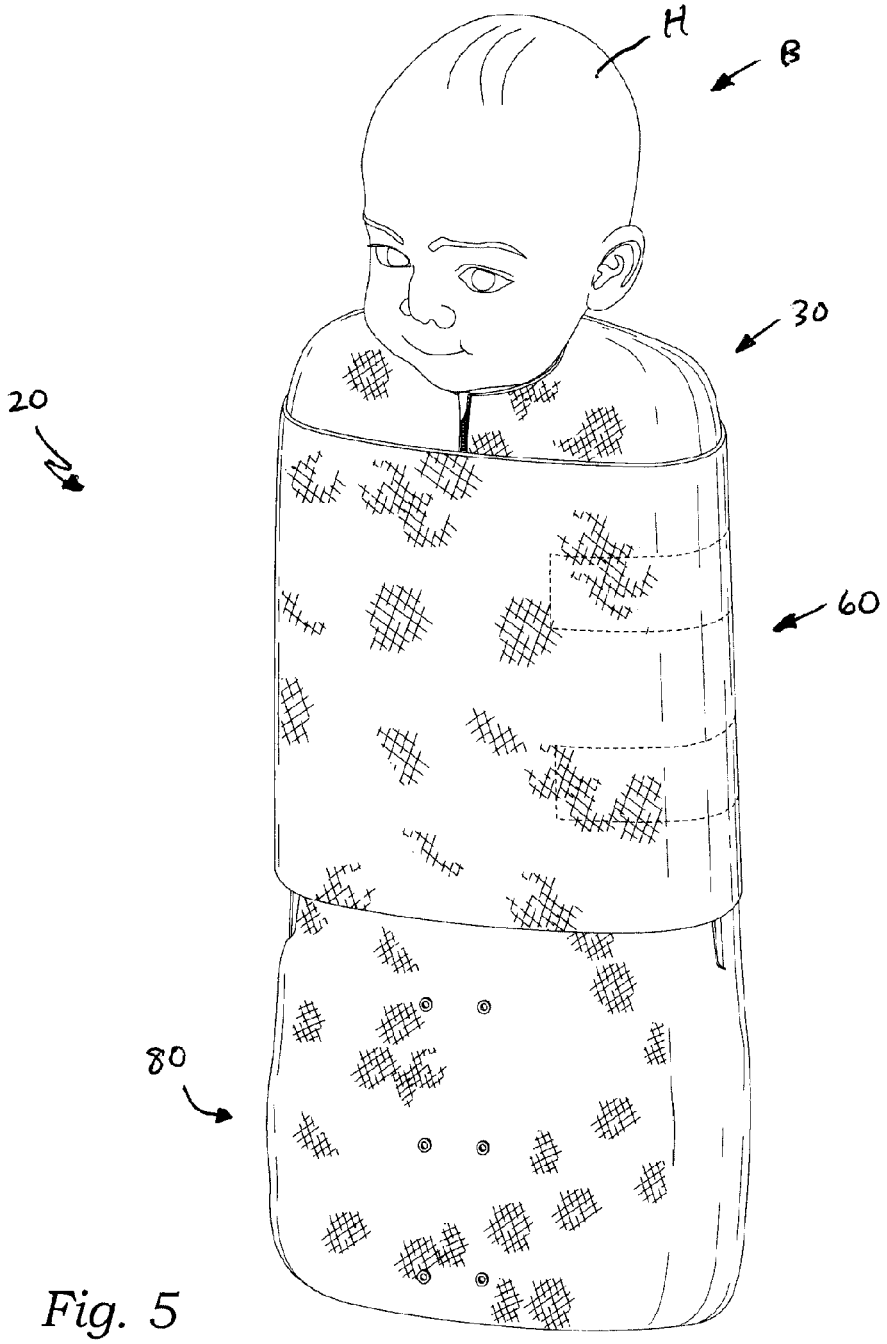
FIG. 5 is a perspective view of a baby being swaddled inside the baby swaddle apparatus according to an aspect of the inventive subject matter whereby the blanket portion being wrapped around the torso portion.

FIG. 5 continues the scenario of FIG. 4 and provides an exemplary embodiment of the baby B being swaddled within the baby swaddle apparatus 20 and showing a configuration in where the user has chosen to wrap the blanket portion 60 around the torso portion 30 and has secured the blanket portion 60 to the torso left panel 40 by the aforementioned fastener panels (48, 68). In this configuration, the baby's B arms are given additional immobilization by the use of the blanket portion 60 in combination with a fastened torso portion 30. In another preferred embodiment, to accommodate in changes in temperature, the user may choose to choose this blanket wrapped configuration to not only provide additional swaddling support but to also provide additional warmth for the baby. In another preferred embodiment, the blanket portion 60 may come in a variety of thicknesses and materials to accommodate different temperature environments. In one exemplary embodiment, the baby swaddle 20 may contain a lighter thin blanket portion 60 for use in warmer environments while another exemplary embodiment may contain a thicker blanket portion 60 for use in colder environments.

Figure 6:
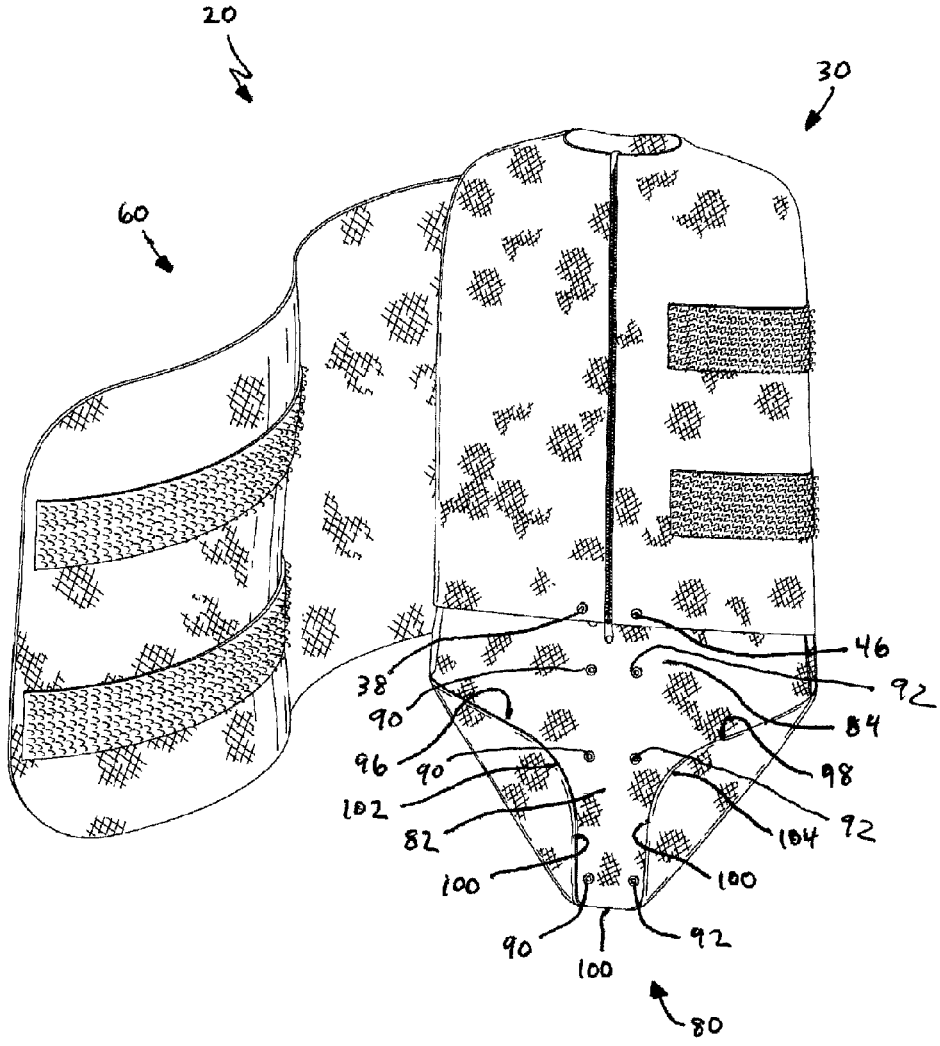
FIG. 6 is a perspective view of the baby swaddle apparatus according to an aspect of the inventive subject matter showing the torso portion in an unfastened position and both pouch corners folded substantially upward in the direction of the torso portion.
Figure 7:
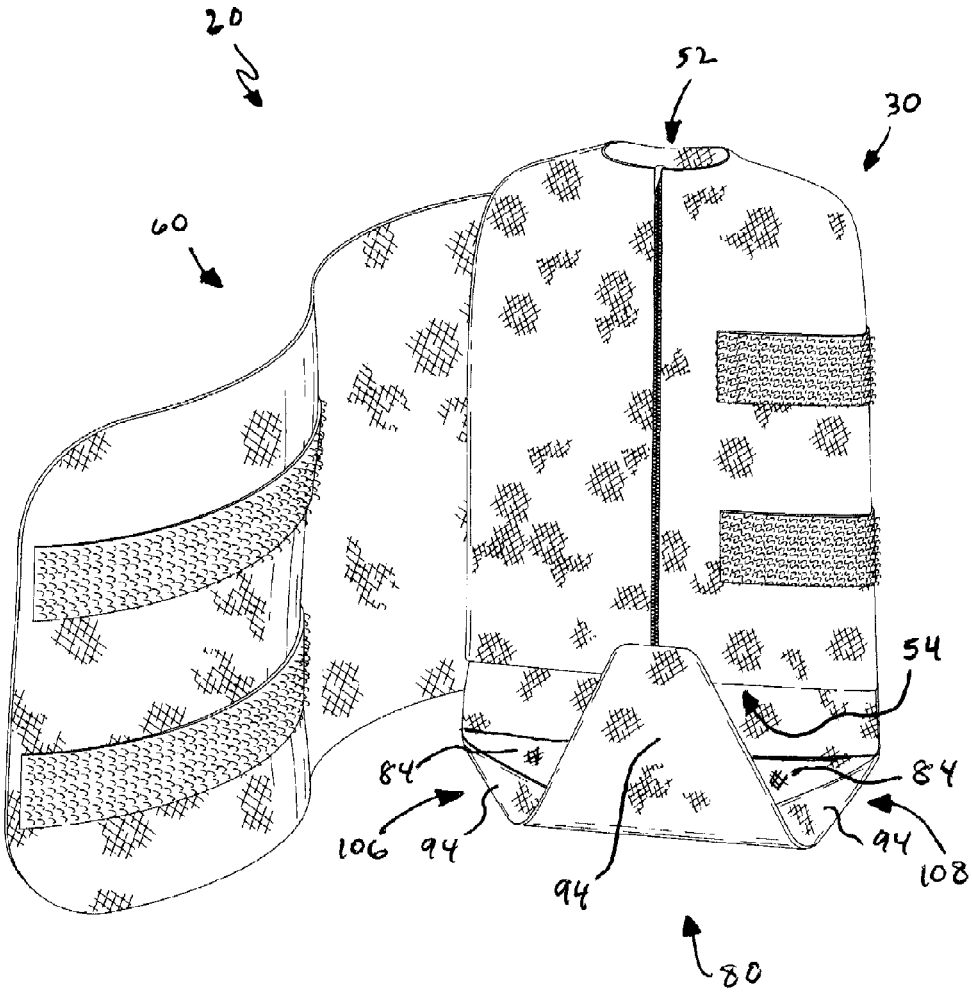
FIG. 7 is a perspective view of the baby swaddle apparatus according to an aspect of the inventive subject matter showing the torso portion in an unfastened position and both pouch corners folded substantially upward in the direction of the torso portion and being removably joined therewith thereby creating right and leg openings.

Turning to FIG. 6 and FIG. 7, an exemplary embodiment of the baby swaddle apparatus 20 is shown wherein the torso portion 30 is in a fastened position but the pouch is in a converted configuration where the pouch right lengthwise edge 96, the pouch left lengthwise edge 98, the pouch bottom edge 100, the pouch right corner 102 and the pouch left corner 104 are folded substantially upward in the direction of the torso portion 30 so as to form a first space 106 and a second space 108 enabling the legs of a baby to be positioned substantially within the pouch portion between the pouch front and rear panels (82, 94) and pouch front panel flap 84. To secure the pouch bottom edge 100 area to the torso portion 30, the user would secure one of the pouch front fasteners (90, 92) to the torso front panel fasteners (38, 46). Depending on the desired size of the first space 106 and second space 108 to accommodate the baby's legs, the user would select the appropriate fasteners 90, 92 to use to secure the pouch to the torso front panel. For example, in one preferred embodiment, if the user wanted a larger first and second space (106, 108), the user would simply select the fasteners (90, 92) that are closest to the pouch bottom edge 100 and attach them to the torso portion 30 by torso front panel fasteners (38, 46). However, in another preferred embodiment, if the user wanted a smaller first and second space (106, 108) to fit a smaller baby for instance, the user would select the middle fasteners (90, 92) closer to the torso portion 30 and attach them to the torso portion 30 by torso front panel fasteners (38, 46).

Figure 8:
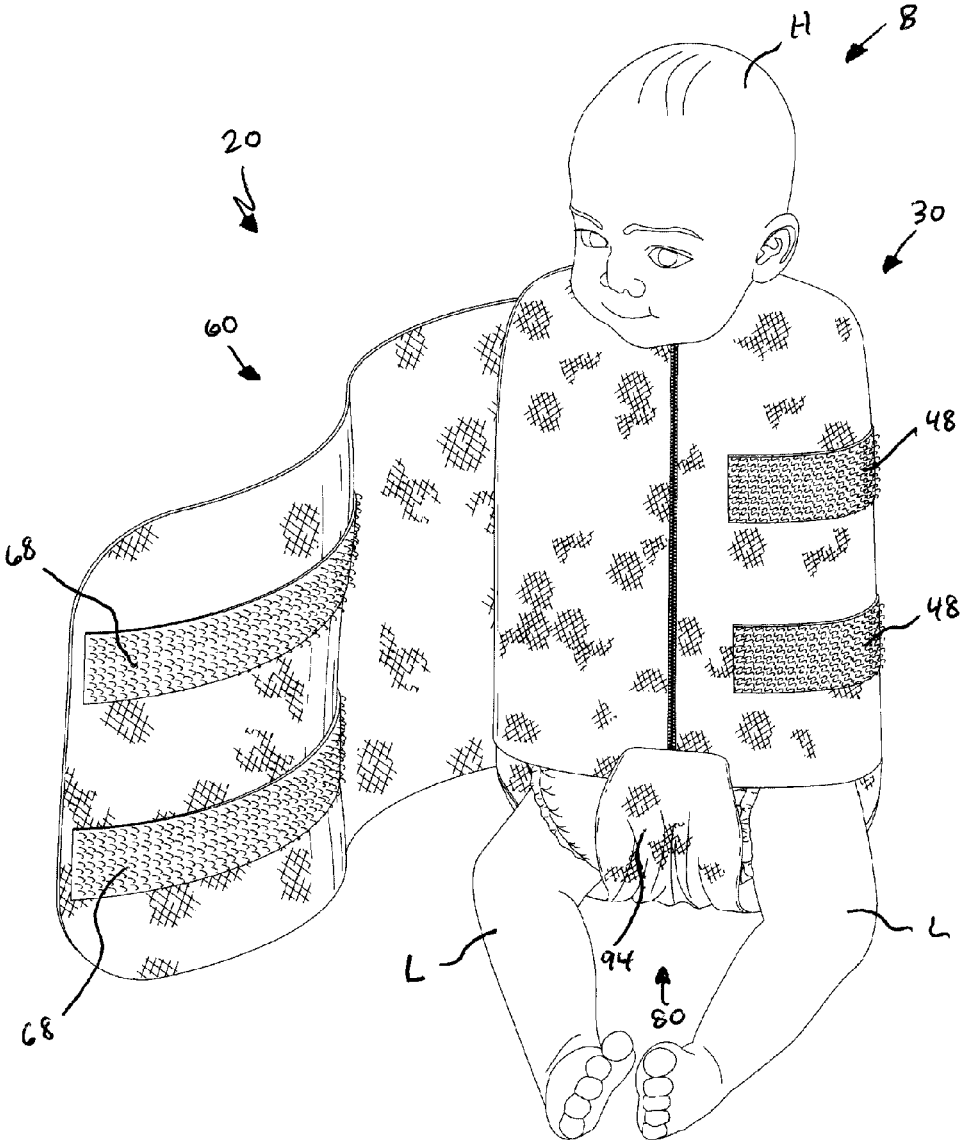
FIG. 8 is a perspective view of a baby being swaddled inside the baby swaddle apparatus according to an aspect of the inventive subject matter depicting a legs-free and unwrapped blanket configuration.

FIG. 8 then depicts an exemplary embodiment of a baby B being swaddled in the baby swaddle apparatus 20 in a torso portion 30 fastened and blanket portion 60 un-fastened legs-free type of swaddling configuration. As seen clearly here, the baby's legs L are free and unencumbered by the pouch portion 80 of the baby swaddle device 20. In this configuration, the pouch rear panel 94 is now seen as the front when secured to the torso portion 30 by fasteners (38, 46, 90, 92). The ability of the baby swaddle device 20 to allow the user to adjust the pouch portion 80 to fit a variety of size babies is one of the objects of the present invention.

Figure 9:
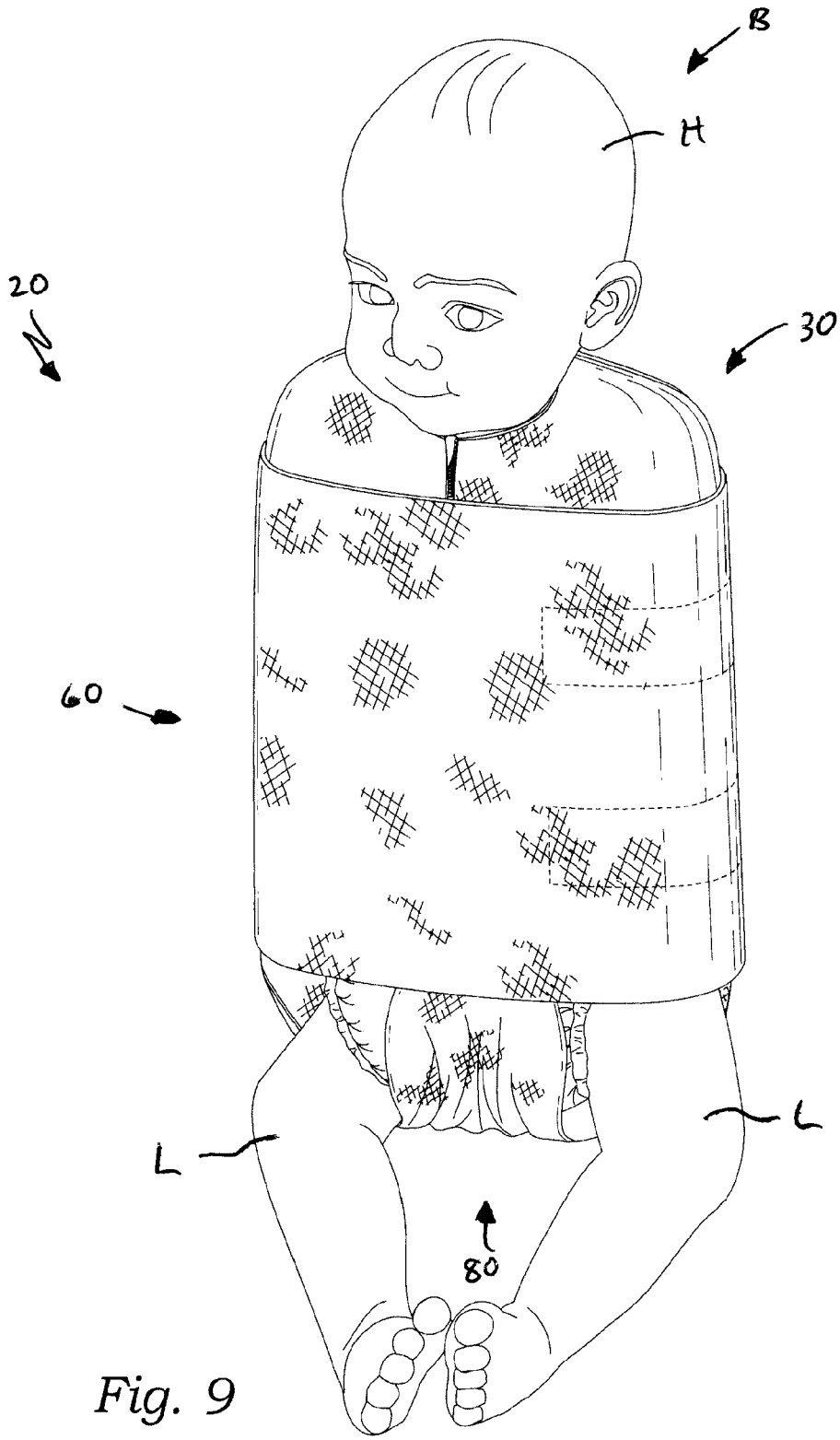
FIG. 9 is a perspective view of a baby being swaddled inside the baby swaddle apparatus according to an aspect of the inventive subject matter depicting a legs-free and wrapped blanket configuration.

FIG. 9 depicts the same exemplary embodiment shown in FIG. 8 but now with the baby swaddle apparatus 20 being in both the fastened torso portion 30 and the fastened blanket portion 60 thereby maximizing the immobilization features of the baby swaddle device 20. Still, even in this swaddle configuration, there may be times when it is desirable to allow the baby's legs L to be free and unencumbered for comfortability purposes.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

Thus, specific embodiments and applications of a baby swaddling apparatus have been disclosed. It should be apparent, however, to those skilled in the art that many more modifications besides those already described are possible without departing from the inventive concepts herein. The inventive subject matter, therefore, is not being restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined within the scope of the defined elements. The claims are thus to be understood to include what is specifically illustrated and described above, what is conceptually equivalent, what can be obviously substituted and also what essentially incorporates the essential idea of the invention. In addition, where the specification and claims refer to at least one of something selected from a group consisting of A, B, C . . . and N, the text should be interpreted as requiring only one element from the group, not A plus N, or B plus N etc.

The invention claimed is:

1. A baby swaddle apparatus for selectively swaddling a baby, comprising:

a torso portion having a torso front right panel and a torso front left panel each joined to a torso rear panel, the torso portion further having a torso neck opening and an opposite torso waist opening and being selectively openable and closable between the neck and waist openings along the torso front right and left panels;

a blanket portion having a blanket panel joined to the torso rear panel and configured to selectively wrap at least partially around the torso portion; and a pouch portion having a pouch front panel joined to a substantially opposite pouch rear panel, the pouch rear panel being further joined to the torso rear panel adjacent the torso waist opening, whereby in a first operable configuration of the apparatus the pouch front panel is spaced from the pouch rear panel and removably joined to the torso portion so as to form a first space within the apparatus bounded by the torso portion and the pouch portion, thereby enabling the legs of the baby to be positioned substantially within the pouch portion between the pouch front and rear panels and thus the apparatus to substantially enclose the baby other than the head, and whereby in a second operable configuration of the apparatus the pouch front and rear panels are brought substantially adjacent and the pouch portion is gathered and folded substantially upwardly in the direction of the torso portion so as to be removably joined thereto, with a fastener in direct contact with a bottom portion of the pouch front panel, and form a second space bounded by the torso portion with right and left leg openings between the torso portion and the pouch portion, thereby enabling the legs of the baby to be substantially free of the apparatus even while the baby is positioned therein, and further whereby whether in the first or second operable configuration of the apparatus, the blanket portion is selectively wrapped substantially at least partially around the torso portion so as to further confine the baby within the apparatus, whereby in both the first and second operable configurations of the apparatus and irrespective of the position of the blanket portion, the baby may be accessed via the pouch portion for diaper changing with minimal disruption to the baby.

2. The apparatus of claim 1 wherein:

the torso front right panel is configured with a torso front right panel fastener;

the torso front left panel is configured with a torso front left panel fastener;

the fastener is a pouch front panel right exterior fastener, a pouch front panel left exterior fastener or a combination thereof with the pouch front panel right exterior fastener spaced-apart from the pouch front panel left exterior fastener;

the pouch front panel is further configured with a selectively foldable pouch front panel flap having a pouch front panel right interior fastener and a spaced-apart pouch front panel left interior fastener, whereby in the first operable configuration of the apparatus the pouch front panel right interior fastener is removably engaged with the torso front right panel fastener and the pouch front panel left interior fastener is removably engaged with the torso front left panel fastener so as to form the first space within the apparatus bounded by the torso portion and the pouch portion, and whereby in the second operable configuration of the apparatus the pouch front panel right exterior fastener is removably engaged with the torso front right panel fastener and the pouch front panel left exterior fastener is removably engaged with the torso front left panel fastener so as to removably join the upwardly-folded pouch front panel with the torso front left and right panels and form the second space bounded by the torso portion with right and left leg openings between the torso portion and the pouch portion; and said fasteners selected from a group consisting of a hook and loop type fastener, buttons, and button holes, zippers, snaps, laces and equivalent fasteners.

3. The apparatus of claim 2 wherein multiple pairs of pouch front panel right and left exterior fasteners are configured on the pouch front panel, whereby select pouch front panel right and left exterior fasteners may be employed in the second operable configuration of the apparatus so as to adjust the effective sizes of the second space and of the right and left leg openings.

4. The apparatus of claim 2 wherein:

the pouch front panel is joined to the substantially opposite pouch rear panel along a pouch bottom edge and along a pouch right lengthwise edge and an opposite pouch left lengthwise edge;

a pouch right corner is formed substantially at the intersection of the pouch bottom edge and the pouch right lengthwise edge; and a pouch left corner is formed substantially at the intersection of the pouch bottom edge and the pouch left lengthwise edge, whereby in the second operable configuration of the apparatus the pouch right and left corners are folded inwardly toward each other prior to folding the pouch portion upwardly so as to narrow the overall pouch portion while leaving the pouch front panel right and left exterior fasteners exposed for removable engagement with the respective torso front right and left panel fasteners when the apparatus is employed in the second operable configuration.

5. The apparatus of claim 1 wherein the torso front right panel is configured with a torso front right panel zipper along a torso front right panel edge; and the torso front left panel is configured with a torso front left panel zipper along a torso front left panel edge, the torso front right panel zipper and the torso front left panel zipper cooperating to selectively open and close the torso portion between the torso front right panel and the torso front left panel through operation of an integral zipper pull.

6. The apparatus of claim 1 wherein:

the torso front left panel is further configured with at least one torso front left panel fastener;

the blanket panel has a blanket panel proximal edge joined to the torso rear panel and an opposite free blanket panel distal edge and further has a blanket panel exterior side and an opposite blanket panel interior side, the blanket panel interior side being configured with at least one blanket panel fastener configured to selectively engage the at least one torso front left panel fastener for selectively removably securing the blanket portion about the torso portion; and said fasteners selected from a group consisting of a hook and loop type fastener, buttons, and button holes, zippers, snaps, laces and equivalent fasteners.

7. A baby swaddle apparatus for selectively swaddling a baby, comprising:

a torso portion having a torso neck opening and an opposite torso waist opening and being selectively openable and closable between the torso neck and waist openings;

a blanket portion joined to the torso portion and configured to selectively wrap at least partially around the torso portion; and a pouch portion joined to the torso portion and having a means for selectively shifting between a first operable configuration of the apparatus wherein a first space is formed within the apparatus bounded by the torso portion and the pouch portion, thereby enabling the legs of the baby to be positioned substantially within the pouch portion and thus the apparatus to substantially enclose the baby other than the head, and a second operable configuration of the apparatus wherein a second space is bounded by the torso portion with right and left leg openings formed between the torso portion and the pouch portion, with a fastener in direct contact with a bottom portion of a pouch front panel of the pouch portion, thereby enabling the legs of the baby to be substantially free of the apparatus even while the baby is positioned therein, whereby whether in the first or second operable configuration of the apparatus, the blanket portion is selectively wrapped substantially at least partially around the torso portion so as to further confine the baby within the apparatus, and further whereby in both the first and second operable configurations of the apparatus and irrespective of the position of the blanket portion, the baby may be accessed via the pouch portion for diaper changing with minimal disruption to the baby.

8. The apparatus of claim 7 wherein the shifting means comprises a pouch front panel joined to a substantially opposite pouch rear panel, the pouch rear panel being joined to a torso rear panel of the torso portion adjacent the torso waist opening, whereby in the first operable configuration of the apparatus the pouch front panel is spaced from the pouch rear panel and removably joined to the torso portion so as to form the first space within the apparatus, and whereby in the second operable configuration of the apparatus the pouch front and rear panels are brought substantially adjacent and the pouch portion is gathered and folded substantially upwardly in the direction of the torso portion so as to be removably joined therewith and form the second space bounded by the torso portion with right and left leg openings between the torso portion and the pouch portion.

9. The apparatus of claim 8 further comprising means for selectively removably joining the pouch portion to the torso portion.

10. The apparatus of claim 9 wherein the joining means comprises:

a torso front right panel fastener formed on a torso front right panel of the torso portion integral with the torso rear panel;

a torso front left panel fastener formed on a torso front left panel of the torso portion integral with the torso rear panel;

the fastener as a pouch front panel right exterior fastener, a pouch front panel left exterior fastener, or a combination thereof spaced-apart and formed on the pouch front panel;

a pouch front panel right interior fastener and a spaced-apart pouch front panel left interior fastener formed on a selectively foldable pouch front panel flap configured on the pouch front panel, whereby in the first operable configuration of the apparatus the pouch front panel right interior fastener is removably engaged with the torso front right panel fastener and the pouch front panel left interior fastener is removably engaged with the torso front left panel fastener so as to form the first space within the apparatus bounded by the torso portion and the pouch portion, and whereby in the second operable configuration of the apparatus the pouch front panel right exterior fastener is removably engaged with the torso front right panel fastener and the pouch front panel left exterior fastener is removably engaged with the torso front left panel fastener so as to removably join the upwardly-folded pouch front panel with the torso front left and right panels and form the second space bounded by the torso portion with right and left leg openings between the torso portion and the pouch portion; and said fasteners selected from a group consisting of a hook and loop type fastener, buttons, and button holes, zippers, snaps, laces and equivalent fasteners.

11. The apparatus of claim 10 wherein multiple pairs of pouch front panel right and left exterior fasteners are configured on the pouch front panel, whereby select pouch front panel right and left exterior fasteners may be employed in the second operable configuration of the apparatus so as to adjust the effective sizes of the second space and of the right and left leg openings.

12. The apparatus of claim 7 wherein the torso portion further has a torso front right panel and an opposite torso front left panel each joined to the torso rear panel, the torso front right panel having a torso front right panel edge and the torso front left panel having a torso front left panel edge, the torso front right and left panel edges defining a means for selectively opening and closing the torso portion between the neck and waist openings.

13. The apparatus of claim 12 wherein the opening and closing means comprises:

a torso front right panel zipper along the torso front right panel edge; and a torso front left panel zipper along the torso front left panel edge, whereby the torso front right and left panel zippers cooperate in selectively zipping the torso portion closed.

14. The apparatus of claim 7 further comprising a means for securing the blanket portion about the torso portion.

15. The apparatus of claim 14 wherein the securing means comprises:

at least one torso front left panel fastener formed on a torso front left panel of the torso portion;

at least one blanket panel fastener formed on an interior side of a blanket panel of the blanket portion, the at least one blanket panel fastener being configured to selectively engage the at least one torso front left panel fastener for selectively removably securing the blanket portion about the torso portion; and said fasteners selected from a group consisting of a hook and loop type fastener, buttons, and button holes, zippers, snaps, laces and equivalent fasteners.

16. A baby swaddle apparatus for selectively swaddling a baby, comprising:

a torso portion having a torso front right panel and a torso front left panel each joined to a torso rear panel, the torso front right panel being configured with a torso front right panel zipper along a torso front right panel edge and further with a torso front right panel fastener, the torso front left panel being configured with a torso front left panel zipper along a torso front left panel edge and further with a torso front left panel fastener, the torso front right panel zipper and the torso front left panel zipper cooperating to selectively open and close the torso portion between the torso front right panel and the torso front left panel through operation of an integral zipper pull, the torso front left panel being further configured with at least one torso front left panel fastener;

a blanket portion having a blanket panel having a blanket panel proximal edge joined to the torso rear panel and an opposite free blanket panel distal edge and further having a blanket panel exterior side and an opposite blanket panel interior side, the blanket panel interior side being configured with at least one blanket panel fastener configured to selectively engage the at least one torso front left panel fastener;

a pouch portion having a pouch front panel joined to a substantially opposite pouch rear panel along a pouch bottom edge and along a pouch right lengthwise edge and an opposite pouch left lengthwise edge, a pouch right corner being formed substantially at the intersection of the pouch bottom edge and the pouch right lengthwise edge and a pouch left corner being formed substantially at the intersection of the pouch bottom edge and the pouch left lengthwise edge, the pouch rear panel being further joined to the torso rear panel, the pouch front panel further having a pouch front panel flap and being configured with at least two pouch front panel right exterior fasteners and at least two spaced-apart pouch front panel left exterior fasteners, and the pouch front panel flap being configured with a pouch front panel right interior fastener and a spaced-apart pouch front panel left interior fastener, whereby in a first operable configuration of the apparatus the pouch front panel is spaced from the pouch rear panel and the pouch front panel right interior fastener is removably engaged with the torso front right panel fastener and the pouch front panel left interior fastener is removably engaged with the torso front left panel fastener so as to form a space within the apparatus bounded by the torso portion and the pouch portion, thereby enabling the legs of the baby to be positioned substantially within the pouch portion between the pouch front and rear panels and thus the apparatus to substantially enclose the baby other than the head, and in a second operable configuration of the apparatus the pouch front and rear panels are brought substantially adjacent, the pouch right and left corners are folded inwardly toward each other, the pouch portion is folded upwardly, and a select pouch front panel right exterior fastener is removably engaged with the torso front right panel fastener and a corresponding pouch front panel left exterior fastener is removably engaged with the torso front left panel fastener so as to form a space bounded by the torso portion with right and left leg openings between the torso portion and the pouch portion, thereby enabling the legs of the baby to be substantially free of the apparatus even while the baby is positioned therein and the effective sizes of the second space and of the right and left leg openings to be selectively adjusted, and further whereby the blanket portion is selectively wrapped substantially around the torso portion and the at least one blanket panel hook fastener formed on the blanket panel interior side is engaged with the at least one torso front left panel fastener formed on the torso left panel so as to further confine the baby within the apparatus, whereby in both the first and second operable configurations of the apparatus and irrespective of the position of the blanket portion, the baby may be accessed via the pouch portion for diaper changing with minimal disruption to the baby; and said fasteners selected from a group consisting of a hook and loop type fastener, buttons, and button holes, zippers, snaps, laces and equivalent fasteners.

* * * * *